United States Patent [19]

Sato et al.

[11] Patent Number: 4,925,554

[45] Date of Patent: May 15, 1990

[54] HYDROTREATING PROCESS FOR HEAVY HYDROCARBON OILS

[75] Inventors: Goro Sato; Hidehiro Higashi; Katsuhiro Shirono; Yoshio Eto, all of Kitakyushu, Japan

[73] Assignee: Catalysts & Chemicals Industries Co., Ltd., Tokyo, Japan

[21] Appl. No.: 152,656

[22] Filed: Feb. 5, 1988

[51] Int. Cl.[5] ..... C10G 23/02

[52] U.S. Cl. ..... 208/210; 208/210; 208/251 H; 208/216 PP; 208/303

[58] Field of Search ..... 208/210, 211, 251 H, 208/216 PP, 303

[56] References Cited

U.S. PATENT DOCUMENTS

| | | | |
|---|---|---|---|
| 3,696,027 | 10/1972 | Bridge | 208/210 |
| 3,804,644 | 5/1974 | Johnson et al. | 208/251 H |
| 3,901,792 | 8/1975 | Wolk et al. | 208/251 H |
| 4,016,067 | 4/1977 | Fischer et al. | 208/251 H |
| 4,054,508 | 10/1977 | Milstein et al. | 208/210 |
| 4,306,964 | 12/1981 | Angevine | 208/210 |
| 4,340,466 | 7/1982 | Inooku | 208/251 H |
| 4,431,525 | 2/1984 | Hensley, Jr. et al. | 208/251 H |
| 4,619,759 | 10/1986 | Myers et al. | 208/251 H |
| 4,657,663 | 4/1987 | Gardner et al. | 208/251 H |

*Primary Examiner*—Helane Myers

*Attorney, Agent, or Firm*—Flynn, Thiel, Boutel & Tanis

[57] ABSTRACT

An improvement in a process which comprises feeding a heavy hydrocarbon oil and hydrogen to a fixed bed reactor which is charged with a demetallation catalyst at its upper stage and a hydrotreating catalyst at its lower stage, first contacting said feed stock with the demetallation catalyst under hydrotreating conditions and then contacting the same with the hydrotreating catalyst for the purpose of hydrotreating. The improvement comprises providing at the upper stage of the demetallation catalyst bed a small volume of a premetallation catalyst bed, said premetallation catalyst being lower in the activity than the demetallation catalyst. This predemetallation catalyst bed is charged with a catalyst which comprises one kind or more of metals selected from Group IIB, Group IVB, Group VB, Group VIB and Group VIII supported on a porous inorganic oxide carrier, said metals being 0.2 to 3 wt. % in terms of oxide, and has a pore volume of 0.4 to 1.5 ml/g and a void fraction of 55 vol % or more.

7 Claims, No Drawings

HYDROTREATING PROCESS FOR HEAVY HYDROCARBON OILS

BACKGROUND OF THE INVENTION

This invention relates to a multi-stage hydrotreating process for heavy hydrocarbon oils. More particularly, this invention is concerned with the improvement in a process comprising first subjecting heavy hydrocarbon oils to demetallation, and then subjecting the same to hydrodesulfurization.

In recent years, there is every indication that crude oils become heavier and heavier. In the petroleum processing industry, furthermore, there is a growing tendency to subject feed oils to deep-drawing at the stages of atmospheric distillation and vacuum distillation. This comes to attach more importance to hydrotreating of heavy hydrocarbon oils.

The heavy hydrocarbon oils, whose typical examples are atmospheric distilled residuum and vacuum distilled residuum, contain large amounts of metallic contaminants such as vanadium, nickel, iron and the like as well as asphaltene and the like. Accordingly, when hydrotreating the heavy hydrocarbon oil of this sort, a hydrotreating catalyst is generally protected from poisoning caused by the metallic contaminants in the feed oil in the manner of first contacting the feed oil with a demetallation catalyst and then contacting it with a hydrotreating catalyst. As the demetallation catalyst in this case, there is normally used a catalyst comprising supporting Group VI and Group VIII metals on an alumina carrier, said metals being within the range of 8 to 20 wt.% in terms of oxide, and having a macro-pore whose diameter is 600 angstrom or more and a large average pore diameter. As the hydrotreating catalyst, in particular hydrodesulfurizing catalyst, there is generally used a catalyst that is substantially identical in the composition as compared with said demetallation catalyst but has a pore smaller than that of said demetallation, namely an average pore diameter within the range of about 90 angstrom to about 180 angstrom.

In a two-stage process comprising first passing a heavy hydrocarbon oil through a demetallation catalyst under hydrotreating conditions, and then passing it through a hydrotreating catalyst bed, the amounts of coke and metal deposited on said demetallation catalyst bed increase with the lapse of treating hours. Owing to this, the activity of the demetallation catalyst lowers, and the pressure drop on the demetallation catalyst bed increases too. In this situation, there is no way but interrupting the hydrotreating operation, even if a hydrotreating catalyst bed on the understream side is still maintaining a sufficient activity. Accordingly, as the amounts of metallic contaminants contained in the heavy hydrocarbon oil, namely feed oil, increase, it is unavoidable to frequently interrupt the running of the process and exchange the catalyst used. Further, the two-stage process is troublesome in that when the demetallation catalyst bed is hardened by deposition of coke and metal, there must be employed means such as blasting to exchange the catalyst.

SUMMARY OF THE INVENTION

This invention provides a hydrotreating process that comprises passing heavy hydrocarbon oils through a first fixed bed charged with a specific catalyst as referred to afterwards, a second fixed bed charged with a demetallation catalyst and further a third fixed bed charged with a hydrodesulfurizing catalyst in the above mentioned order, under hydrotreating conditions.

Accordingly, the hydrotreating process of this invention includes the steps of (a) passing a heavy hydrocarbon oil and hydrogen through a first fixed catalyst bed being equivalent to 1 to 5 vol% of the total catalyst bed volume under hydrotreating conditions for demetallation, said first fixed catalyst bed being charged with a catalyst comprising supporting, on a porous inorganic oxide carrier, one kind or more of metals selected from Group IIB, Group IVB, Group VB, Group VIB and Group VIII within the range of 0.2 to 3 wt.% in terms of oxide, and having a pore volume within the range of 0.4 to 1.5 ml/g and a void fraction of 55 vol% or more; (b) passing the efflux from said first fixed catalyst bed through a second fixed catalyst bed being equivalent to 4 to 70 vol% of the total catalyst bed volume under hydrotreating conditions for demetallation, said second fixed catalyst bed being charged with a normal demetallation catalyst, and (c) passing the efflux from the second fixed catalyst bed through a third fixed catalyst bed under hydrotreating conditions for hydrotreating, said third fixed catalyst bed being equivalent to 25 to 95 vol% of the total catalyst bed volume and charged with a hydrodesulfurizing catalyst.

DETAILED DESCRIPTION

From the comparison of the process of this invention with the conventional two-stage catalytic process that comprises subjecting a heavy hydrocarbon oil to demetallation and successively hydrotreating the same, it can be observed that the greatest characteristic of the process of this invention is to dispose a pre-demetallation catalyst bed on the upstream side of the demetallation catalyst bed and thus contact the heavy hydrocarbon oil and hydrogen with said predemetallation catalyst before the heavy hydrocarbon oil and hydrogen contact with the demetallation catalyst.

At the time of practicing the process of this invention, it is possible to include the pre-demetallation catalyst bed, the demetallation catalyst bed and the hydrodesulfurizing catalyst bed within a single reactor, and it is also possible to include each of those catalyst beds in a separate reactor. In the former case, there is preferably used a vertical reactor where a feed stock is supplied from its top and flows downwardly therethrough. Said reactor is provided at its upper part with the first catalyst bed charged with the predemetallation catalyst. The predemetallation catalyst comprises supporting one kind or more of active metallic components selected from Group IIB, Group IVB, Group VB, Group VIB and Group VIII on a porous inorganic oxide carrier. As the porous inorganic oxide carrier there may be used for instance alumina, silica, silica-alumina and the like, and as the active metallic component there may be used zinc, titanium, zirconium, vanadium, molybdenum, tungsten, iron, cobalt, nickel and the like. The predemetallation catalyst of this invention contains the active metallic component within the range of 0.2 to 3 wt.% in terms of oxide. In case the active metallic component content is less than 0.2 wt.%, the demetallation ability of this catalyst is too poor to sufficiently remove even the irony contaminants being especially rich in reactivity. Therefore, the use of this catalyst can not achieve the intended effect. On the other hand, the catalyst, whose active metallic component content is more than 3 wt.%, is too high in the demetallation ability. The use of this catalyst in the first catalyst bed deposits even the low-reactive metallic contaminants on the catalyst surface, and has the possibility of hardening the catalyst bed in cooperation with deposition of coke. The predemetallation catalyst arranged within the first catalyst bed is preferred to have a large pore volume.

Taking the mechanical strength into consideration, however, its proper pore volume is within the range of 0.4 to 1.5 ml/g.

The predemetallation catalyst used in the first catalyst bed of this invention preferably has a void fraction of 55 vol% or more. In case the void fraction is less than 55 vol%, there is the possibility of the first catalyst bed being blocked up by the scale and/or mud contained in the heavy hydrocarbon oil, and further by the metallic contaminants and coke deposited on the catalyst surface. However, in case the void fraction of the predemetallation catalyst is too large, the scale and mud pass the first catalyst bed without stopping to thereby block the second catalyst bed. Therefore, it is proper that the void fraction of the predemetallation catalyst should be within the range of 55 to 80 vol%. It is proper that the volume of the first catalyst bed should be within the range of 1 to 5 vol% of the total catalyst beds within the reactor. In the case of the single reactor, if the first bed is enlarged, the volumes of the second catalyst bed charged with the demetallation catalyst and/or the third catalyst bed charged with the hydrodesulfurizing catalyst decrease, whereby it becomes impossible to refine the heavy hydrocarbon oil as intended.

At the lower part or on the downstream side of the first catalyst bed of the reactor, there is provided the second catalyst bed charged with the demetallation catalyst. As this demetallation catalyst, there may be used any one of the catalysts well known as demetallation catalysts in this industry. The second catalyst bed of this invention may be consisted of the catalyst disclosed in U.S. Pat. No. 4,613,425 which comprises supporting at least two kinds of metals selected from Group VB, Group VIB and Group VIII on a carrier consisting essentially of gamma-alumina and has a pore volume of 0.57 to 0.95 ml/g, said selected metals being 3 to 8 wt.% in terms of oxide. When any demetallation catalyst is used in the second catalyst bed, it is proper that its void fraction should generally be 55 vol% or less. The volume of the second catalyst bed is within the range of 4 to 70 vol% of the total volume of catalyst beds.

At the lower part or on the downstream side of the said second catalyst bed, there is provided the third catalyst bed charged with the hydrodesulfurizing catalyst.

In the case of a single reactor, this catalyst bed is located at its lowermost stage. In the third catalyst bed, there may be used any one of the conventional catalysts including the usual hydrodesulfurizing catalysts referred to previously.

The third catalyst bed commonly occupies 25 to 95 vol% of the total catalyst beds. The heavy hydrocarbon oil passes the first, second and third catalyst beds in the abovementioned turn under hydrotreating conditions. As the hydrotreating conditions of this invention, there may be employed those which have been commonly used in hydrotreating heavy hydrocarbon oils. Those hydrotreating conditions include the temperature 340°–450° C.; the hydrogen partial pressure 40 to 250 $Kg/cm^2$, preferably 70 to 240 $Kg/cm^2$; the hydrogen flow rate 500 to 2000 $Nm^3/kl$; and the liquid space velocity (LHSV) 0.1 to 5.0 $hr^{-1}$, preferably 0.2 to 4.0 $hr^{-1}$.

The process of this invention comprises three-stage treating, and is different in this point from the usual two-stage fixed catalyst beds (demetallation catalyst bed+hydrodesulfurizing catalyst bed). However, this fact does not always mean that the total volume of the fixed catalyst beds of this invention is larger than that of the usual fixed catalyst beds. Accordingly, when practising the process of this invention using the existing vertical reactor, it is possible to somewhat reduce the volume of the demetallation catalyst bed than that of the usual fixed catalyst beds to thereby form the first catalyst bed thereon.

Further, it is also possible to remove part of the ceramic balls charged normally at the top of the fixed catalyst bed and provide the first catalyst bed of this invention thereat.

According to the process of this invention, the heavy hydrocarbon oil supplied to the reactor first passes through the first catalyst bed, but the catalyst charged herein is lower in the point of demetallation activity than the demetallation catalyst charged in the second catalyst bed. The iron-type contaminants, being especially rich in reactivity among the metallic contaminants contained in heavy hydrocarbon oils, are chiefly removed in the first catalyst bed and vanadium and nickel contaminants are removed in the second catalyst bed. In other words, the removal of metallic contaminants is allotted to two catalyst beds. Therefore, it is estimated that the possibility of both catalyst beds being blocked by metallic contaminants is reduced.

EXAMPLE 1

Reference will be made to the preparation of catalysts.

Precipitate of alumina hydrate was prepared from an aqueous sodium aluminate solution and an aqueous aluminium sulfate solution in a usual manner. This precipitate was washed, thereafter kneaded, and subjected to an extruder, thereby obtaining several kinds of different-shaped extrudates to obtain catalysts having various void fractions. These extrudates were dried and sintered. By supporting active metal components thereon in a usual manner, there were obtained catalysts shown in Table 1.

TABLE 1

| | For use in first bed | | | | | For use in second bed Demetallation catalyst | For use in third bed Hydrodesulfurizing catalyst |
|---|---|---|---|---|---|---|---|
| | Catalyst A | Catalyst B | Catalyst C | Catalyst D | Catalyst E | | |
| Shape | Ring | | Four-leaf Ring | | | Cylindrical | Cylindrical |
| Outer diameter | ¼" | ¼" | ⅛" | ⅛" | ¼" | 1/16" | 1/16" |
| $MoO_3$, wt % | 0.1 | 0.5 | 1.0 | 0.1 | 1.0 | 1.5 | 10.5 |
| CoO, wt % | — | — | — | — | — | — | 1.7 |
| NiO, wt % | 0.2 | 1.0 | 1.5 | 0.2 | 1.5 | 3 | — |

TABLE 1-continued

| | For use in first bed | | | | | For use in second bed Demetallation catalyst | For use in third bed Hydrodesulfurizing catalyst |
|---|---|---|---|---|---|---|---|
| | Catalyst A | Catalyst B | Catalyst C | Catalyst D | Catalyst E | | |
| $V_2O_5$, wt % | 0.2 | 1.0 | 1.5 | 0.2 | 1.5 | 3 | — |
| VF, vol % | 61 | 65 | 52 | 52 | 65 | 43 | 43 |
| PV, ml/g | 0.72 | 0.71 | 0.69 | 0.69 | 0.70 | 0.67 | 0.65 |
| SA, $m^2/g$ | 232 | 228 | 225 | 226 | 225 | 215 | 200 |

VF = Void fraction, PV = Pore volume, SA = Surface area

EXAMPLE 2

The lowermost part of an upright reaction tube (inner diameter: 19.2 mmϕ, length: 3000 mm) was charged with a proper amount of ceramic balls. Thereon were charged the hydrodesulfurizing catalyst shown in Table 1, next the demetallation catalyst shown in Table 1, further Catalyst A for use in the first bed shown in Table 1, and lastly ceramic balls to prepare a reactor having three-layer structured fixed catalyst beds. The ratio of each catalyst bed to the total catalyst beds is shown in Run 1 of Table 2. A heavy hydrocarbon oil was fed downwardly together with hydrogen to this reactor for hydrotreating. As the reaction conditions, there were employed LHSV 0.5 $hr^{-1}$, hydrogen/hydrocarbon ratio 700 $Nm^3/kl$, and hydrogen pressure 135 $kg/cm^2$. The reaction temperature was controlled within the range of 380° to 410° C. so that the sulfur content of a product oil might be maintained at 0.6 wt.%. The properties of the heavy hydrocarbon oil (AHRC) used as the feed material are as follows.

| Properties of charge stock | |
|---|---|
| Specific gravity, 15/4° C. | 0.990 |
| Sulfur, wt. % | 4.1 |
| Nitrogen, ppm | 3000 |

-continued

| Properties of charge stock | |
|---|---|
| Viscosity, C.S. at 50° C. | 2900 |
| Asphaltene, wt. % | 8.2 |
| Fe, ppm | 10 |
| Ni, ppm | 26 |
| V, ppm | 91 |
| Na, ppm | 2 |

After 4500 hours' oil supply had been continued, the reaction was discontinued.

The reacting tube was divided to observe the presence of hardening and blockade of the catalyst bed located just under the uppermost ceramic ball bed and further the amount of metal deposited on said catalyst. The exactly same hydrotreatment as mentioned above except that the catalytic structure within the reacting tube and the catalyst used in the first bed were changed as shown in Table 2, was carried out. The experimental results are shown in Table 3.

TABLE 2

| | Run 1 | Run 2 | Run 3 | Run 4 | Run 5 | Run 6 | Run 7 |
|---|---|---|---|---|---|---|---|
| 1st bed | 1.5 vol % Catalyst A | 4 vol % Catalyst B | 1 vol % Catalyst B | — | 4 vol % Catalyst C | 4 vol % Catalyst D | 4 vol % Catalyst E |
| 2nd bed (Demetallation catalyst) | 18.5 vol % | 16 vol % | 19 vol % | 20 vol % | 16 vol % | 16 vol % | 16 vol % |
| 3rd bed (Hydrodesulfurizing catalyst) | 80 vol % | 80 vol % | 80 vol % | 80 vol % | 80 vol % | 80 vol % | 80 vol % |

TABLE 3

| | Run 1 | Run 2 | Run 3 | Run 4 | Run 5 | Run 6 | Run 7 |
|---|---|---|---|---|---|---|---|
| Uppermost catalyst bed | | | | | | | |
| Hardening | none | none | none | observed | observed | none | observed |
| Blockade | none | none | none | observed | observed | observed | none |
| Relative value of reaction temperature | | | | | | | |
| SOR | 100 | 92 | 99 | 98 | 99 | 100 | 99 |
| EOR | 100 | 102 | 99 | 103 | 103 | 100 | 103 |
| Relative value of pressure drop | | | | | | | |
| SOR | 100 | 100 | 100 | 100 | 100 | 100 | 100 |
| EOR | 100 | 135 | 150 | 500 | 400 | 450 | 200 |
| Deposits of uppermost catalyst | | | | | | | |
| C, wt % | 32.7 | 40.1 | 39.0 | 50.0 | 46.0 | 41.0 | 47.0 |
| S, wt % | 13.2 | 13.9 | 14.1 | 51.0 | 15.3 | 14.0 | 16.0 |
| Fe, wt % | 3.1 | 2.5 | 2.7 | 7.5 | 2.8 | 2.7 | 3.0 |
| Na, wt % | 0.5 | 0.4 | 0.4 | 0.25 | 0.32 | 0.5 | 0.4 |
| Ni, wt % | 2.3 | 2.9 | 3.1 | 11.0 | 5.8 | 1.5 | 4.9 |
| V, wt % | 9.9 | 10.5 | 10.9 | 34.3 | 13.2 | 8.7 | 14.2 |

Note: Runs 4 to 7 are controls.

It is apparent from the experimental results shown in Table 3 that according to the process of this invention, the catalyst layer located at the uppermost part of the catalyst bed is substantially free from hardening and blockade, and is also free from pressure drop even when hydrotreating is continued for a long period of time.

Referring to the desulfurizing activity, furthermore, the process of this invention is slightly inferior at the early period of reaction to Run 4 with no first catalyst bed added, but exhibits the desulfurizing activity exceeding that of Run 4 when the reaction is continued. Run 3 shows that the first catalyst bed is effectively working to prevent the increase of pressure drop even though the volume % occupied by the first catalyst bed to the whole catalyst beds is little, namely 1 vol%. In the case of Run 6, the first catalyst bed is hardened because the void fraction of Catalyst D used in the first catalyst bed does not satisfy the range of 55 wt.% or more prescribed by this invention. In the case of each of Runs 5, 7, the catalyst used in the first catalyst bed displays a relatively high demetallation activity, whereby the hardening and/or blockade caused by accumulation of metallic contaminants take place in the first catalyst bed.

We claim:

1. A hydrotreating process for heavy hydrocarbon oils comprising the steps of (a) passing a heavy hydrocarbon oil and hydrogen through a first fixed catalyst bed containing 1 to 5 vol% of the total catalyst bed volume under hydrotreating conditions for demetallation, said first fixed catalyst bed being charged with a catalyst comprising supporting on a porous inorganic oxide carrier, one or more metals selected from Group IIB, Group IVB, Group VB, Group VIB and Group VIII within the range of 0.2 to 3 wt.% in terms of oxide, and having a pore volume within the range of 0.4 to 1.5 ml/g and a void fraction of 55 vol% or more; (b) passing the efflux from said first fixed catalyst bed through a second fixed catalyst bed containing 4 to 70 vol% of the total catalyst bed volume under hydrotreating conditions for demetallation, said second fixed catalyst bed being charged with a demetallation catalyst, said demetallation catalyst comprising at least two kinds of metals selected from Group VB, Group VIB and Group VIII supported on a porous inorganic oxide carrier and having a pore volume of 0.57 to 0.95 ml/g and a void fraction of 55 vol% or less, the amount of said metals being 3 to 8 wt.% in terms of oxide, and (c) passing the efflux from the second fixed catalyst bed through a third fixed catalyst bed under hydrotreating conditions for hydrotreating, said third fixed catalyst bed containing 25 to 90 vol% of the total catalyst bed volume and charged with a hydrodesulfurizing catalyst, said catalyst of said first fixed catalyst bed having (1) a larger void fraction, (2) a larger pore volume and (3) a lower wt.% of catalyst metal in terms of oxide than the catalyst of said second fixed catalyst bed.

2. The process of claim 1, wherein the porous inorganic oxide carrier for the catalyst used in the first catalyst bed is alumina, silica or silica-alumina.

3. The process of claim 1, wherein the porous inorganic oxide carrier consists essentially of gamma-alumina.

4. In a process for hydrotreating a heavy hydrocarbon oil containing metals and sulfur compounds, in which hydrogen and said oil are passed in series, under hydrotreating conditions, through a bed of demetallation catalyst particles and then through a bed of hydrodesulfurizing catalyst particles, the improvement which comprises; passing said hydrogen and said oil through a bed of pre-demetallation catalyst particles prior to passing said hydrogen and said oil through said beds of demetallation catalyst particles and hydrodesulfurizing catalyst particles, said demetallation catalyst particles comprising at least two kinds of metals selected from Group VB, Group VIB and Group VIII supported on a porous inorganic oxide carrier and having a pore volume of 0.57 to 0.95 ml/g and a void fraction of 55 vol% or less, the amount of said metals being 3 to 8 wt.% in terms of oxide, the volume of said bed of pre-demetallation catalyst particles being from 1 to 5 vol%, based on the total volume of all three catalyst beds, said pre-demetallation catalyst particles consisting essentially of at least one metal selected from the group consisting of the metals of Group IIB, Group IVB, Group VB, Group VIB and Group VIII of the Periodic Table of the Elements, said metal being supported on a porous inorganic oxide carrier, the amount of said metal in said pre-demetallation catalyst being in the range of 0.2 to 3 wt%, calculated as the oxides, said pre-demetallation catalyst having a pore volume of 0.4 to 1.5 ml/g and a void fraction of from 55 to 80 vol%; the volume of said bed of demetallation catalyst particles being from 4 to 70 vol%, based on the total volume of all three catalyst beds, and the volume of said bed of hydrodesulfurizing catalyst particles being from 25 to 95 vol%, based on the total volume of all three catalyst beds, said pre-demetallation catalyst particles having (1) a larger void fraction, (2) a larger pore volume and (3) a lower wt.% of catalyst metal in terms of oxide than said demetallation catalyst particles.

5. A process as claimed in claim 4 in which said porous inorganic oxide carrier consists essentially of gamma-alumina.

6. A process as claimed in claim 4 in which said demetallation catalyst particles consist essentially of demetallation catalyst metals selected from the group consisting of the metals of Group VIB and Group VIII of the Periodic Table of the Elements, said demetallation catalyst metals being deposited on an alumina carrier, the amount of said demetallation catalyst metals being in the range of 8 to 20 wt%, calculated as the oxides, said demetallation catalyst particles having macro-pores of a diameter of 600 Angstrom units or higher and having a large average pore diameter, said hydrodesulfurizing catalyst particles having a composition within the scope of the composition of said demetallation catalyst particles and having an average pore diameter of from 90 to 180 Angstrom units.

7. In a process for hydrotreating a heavy hydrocarbon oil containing metals and sulfur compounds, in which hydrogen and said oil are passed in series, under hydrotreating conditions, through a bed of demetallation catalyst particles and then through a bed of hydrodesulfurizing catalyst particles, the improvement which comprises; passing said hydrogen and said oil through a bed of pre-demetallation catalyst particles prior to passing said hydrogen and said oil through said beds of demetallation catalyst particles and hydrodesulfurizing catalyst particles, said demetallation catalyst particles comprising at least two kinds of metals selected from Group VB, Group VIB and Group VIII supported on a porous inorganic oxide carrier and having a pore volume of 0.57 to 0.95 ml/g and a void fraction of 55 vol% or less, the amount of said metals being 3 to 8 wt.% in terms of oxide, the volume of said bed of pre-demetallation catalyst particles being from 1 to 5 vol%, based on the total volume of all three catalyst beds, said pre-demetallation catalyst particles consisting essentially of at least one metal selected from the group consisting of zinc, titanium, zirconium, vanadium, molybdenum, tungsten, iron, cobalt and nickel, said metal being supported on a porous inorganic oxide carrier, the amount of said metal in said pre-demetallation catalyst being in the range of 0.2 to 3 wt.%, calculated as the oxides, said pre-demetallation catalyst having a pore volume of 0.4 to 1.5 ml/g and a void fraction of from 55 to 80 vol%, the volume of said bed of demetallation catalyst particles being from 4 to 70 vol%, based on the total volume of all three catalyst beds, and the volume of said bed of hydrodesulfurizing catalyst particles being from 25 to 95 vol%, based on the total volume of all three catalyst beds, said pre-demetallation catalyst particles having (1) a larger void fraction, (2) a larger pore volume and (3) a lower wt.% of catalyst metal in terms of oxide than said demetallation catalyst particles.

* * * * *